US011896091B2

(12) United States Patent
Demeglio

(10) Patent No.: US 11,896,091 B2
(45) Date of Patent: Feb. 13, 2024

(54) JEWELRY ITEM COMPRISING AN ELASTIC ELEMENT AND A PLURALITY OF DECORATIVE ELEMENTS THREADED ONE AFTER THE OTHER ON THE ELASTIC ELEMENT SO AS TO BE SLIDABLE WITH RESPECT THERETO AND CONNECTED IN TWOS TO ONE ANOTHER

(71) Applicant: ROBERTO DEMEGLIO S.P.A., Turin (IT)

(72) Inventor: Roberto Demeglio, Turin (IT)

(73) Assignee: ROBERTO DEMEGLIO S.P.A.

( * ) Notice: Subject to any disclaimer, the term of this patent is extended or adjusted under 35 U.S.C. 154(b) by 1182 days.

(21) Appl. No.: 16/495,760

(22) PCT Filed: Mar. 20, 2018

(86) PCT No.: PCT/IB2018/051863
§ 371 (c)(1),
(2) Date: Sep. 19, 2019

(87) PCT Pub. No.: WO2018/172936
PCT Pub. Date: Sep. 27, 2018

(65) Prior Publication Data

US 2020/0060391 A1 Feb. 27, 2020

(30) Foreign Application Priority Data

Mar. 21, 2017 (IT) ..... 102017000031034

(51) Int. Cl.
*A44C 5/08* (2006.01)
*A44C 5/02* (2006.01)
*A44C 11/00* (2006.01)

(52) U.S. Cl.
CPC ..... *A44C 5/08* (2013.01); *A44C 5/022* (2013.01); *A44C 11/007* (2013.01)

(58) Field of Classification Search
CPC ..... A44C 5/0069; A44C 5/0076; A44C 5/022; A44C 5/025; A44C 5/04; A44C 5/08; A44C 13/00; A44C 11/007
See application file for complete search history.

(56) References Cited

U.S. PATENT DOCUMENTS 311,722 A * 2/1885 Cottle ..... A44C 5/08 D11/20
687,217 A * 11/1901 Fritschle ..... A44C 5/08 132/75.4

(Continued)

FOREIGN PATENT DOCUMENTS

CN 204989782 U 1/2016
EP 2712513 A2 4/2014

OTHER PUBLICATIONS

International Search Report, issued in PCT/IB2018/051863, dated Jun. 14, 2018, Rijswijk, Netherlands.

*Primary Examiner* — Jack W Lavinder
(74) *Attorney, Agent, or Firm* — Valauskas Corder LLC

(57) ABSTRACT

A jewelry item comprises an elastic element extending over the entire length of the item, a plurality of decorative elements threaded one after the other on the elastic element so as to be slidable with respect thereto, and a plurality of connection elements which are each threaded on the elastic element between a pair of adjacent decorative elements and connect the decorative elements to each other, whereby the adjacent decorative elements are displaceable with respect to each other, sliding on the connection element, between a position of minimum relative distance and a position of maximum relative distance. Each connection element is connected to a first decorative element of the pair of adjacent decorative elements by a first bayonet-type engaging device (Continued)

and to a second decorative element of the pair of adjacent decorative elements by a second bayonet-type engaging device.

5 Claims, 5 Drawing Sheets

(56) References Cited

U.S. PATENT DOCUMENTS

| | | | | | |
|---|---|---|---|---|---|
| 1,515,499 | A * | 11/1924 | Lederer | A44C 11/002 | 63/38 |
| 2,608,050 | A * | 8/1952 | Bender | A44C 5/08 | 63/5.2 |
| 2,667,739 | A * | 2/1954 | Flaig | A44C 5/08 | 63/5.2 |
| 2,753,682 | A * | 7/1956 | Gerstenblith | A44C 5/08 | 59/79.2 |
| 6,220,010 | B1 * | 4/2001 | Gomez | A44C 11/002 | 59/80 |
| 10,271,619 | B1 * | 4/2019 | Peck | A44C 9/02 | |
| 10,306,957 | B2 * | 6/2019 | Scandolaro | A44C 5/025 | |
| 10,537,160 | B1 * | 1/2020 | Busiashvili | A44C 5/102 | |
| 11,116,292 | B2 * | 9/2021 | Demeglio | A44C 11/007 | |
| 2015/0335108 | A1 * | 11/2015 | Chiarini | A44C 5/04 | 29/896.41 |
| 2016/0345690 | A1 * | 12/2016 | Scandolaro | A44C 5/0076 | |

* cited by examiner

JEWELRY ITEM COMPRISING AN ELASTIC ELEMENT AND A PLURALITY OF DECORATIVE ELEMENTS THREADED ONE AFTER THE OTHER ON THE ELASTIC ELEMENT SO AS TO BE SLIDABLE WITH RESPECT THERETO AND CONNECTED IN TWOS TO ONE ANOTHER

CROSS-REFERENCE TO RELATED APPLICATIONS

This application is a National Phase filing of PCT International Application No. PCT/IB2018/051863, having an International Filing Date of Mar. 20, 2018, claiming priority to Italian Patent Application No. 102017000031034, having a filing date of Mar. 21, 2017 each of which is hereby incorporated by reference in its entirety.

BACKGROUND OF THE INVENTION

The present invention generally relates to a jewelry item, such as a bracelet, a necklace or a ring. More specifically, the present invention relates to a jewelry item comprising an elastic element, such as a spring, which extends over the entire length of the item, and a plurality of decorative elements, which are threaded one after the other onto the elastic element so as to be slidable with respect to the latter and are connected in twos to each other.

A jewelry item of this type is known from US 2016/345690.

SUMMARY OF THE INVENTION

It is an object of the present invention to provide a jewelry item of the type identified above, which may be easily assembled and which, once assembled, allows a certain freedom of movement between each decorative element and the adjacent decorative elements and is thus rather flexible.

This and other objects are fully achieved according to the invention by a jewelry item having the features described and claimed herein.

In summary, the invention is based on the idea of providing a jewelry item of the type identified above, wherein each connection element is connected at a first end thereof to a first decorative element by a respective first bayonet-type engaging device and at a second end thereof, longitudinally opposite to the first end, to a second decorative element by a respective second bayonet-type engaging device, wherein said first bayonet-type engaging devices comprise each a first male engaging part formed by a first head portion with an enlarged section of the connection element and a first female engaging part formed by a first through opening on the right face of said first decorative element in communication with an internal cavity of the body of such element, and wherein said second bayonet-type engaging devices comprise each a second male engaging part formed by a second head portion with an enlarged section of the connection element and a second female engaging part formed by a second through opening on the left face of said second decorative element in communication with an internal cavity of the body of such element.

The first bayonet-type engaging devices are configured in such a way that the coupling between each connection element and the respective first decorative element is obtained by insertion of the first male engaging part of the connection element into the first female engaging part of the first decorative element, with the connection element arranged in a given first angular position relative to the first decorative element, and then by rotation of the connection element by a given angle relative to the first decorative element so as to place the connection element in a given second angular position relative to the first decorative element rotated relative to the first angular position. In such second angular position the male engaging part of the connection element is secured in the body of the first decorative element and thus prevents the connection element from disengaging from the first decorative element.

Likewise, the second bayonet-type engaging devices are configured in such a way that the coupling between each connection element and the respective second decorative element is obtained by insertion of the second male engaging part of the connection element into the second female engaging part of the second decorative element, with the connection element arranged in a given first angular position relative to the second decorative element, and then by rotation of the connection element by a given angle relative to the second decorative element so as to place the connection element in a given second angular position relative to the second decorative element rotated relative to the first angular position. In such second angular position, the male engaging part of the connection element is secured in the body of the second decorative element and thus prevents the connection element from disengaging from the second decorative element.

The connection of each pair of adjacent decorative elements with one another is therefore obtained by the following steps:

- insertion of the first male engaging part of the connection element into the first female engaging part of the first decorative element, with the connection element and the first decorative element arranged in the aforesaid first angular position relative to one another;
- rotation of the connection element relative to the first decorative element so as to arrange such elements in the aforesaid second angular position relative to one another;
- insertion of the second male engaging part of the connection element into the second female engaging part of the second decorative element, with the connection element and the second decorative element arranged in the aforesaid first angular position relative to one another; and
- rotation of the connection element relative to the second decorative element so as to arrange such elements in the aforesaid second angular position relative to one another.

The assembly of the jewelry item is thus particularly simple and fast.

Preferably, each connection element is associated with a first rotation-preventing device which prevents the connection element from rotating relative to the first decorative element when these elements are in the aforesaid second angular position relative to one another, as well as a second anti-rotation device which prevents the connection element from rotating relative to the second decorative element when these elements are in the aforesaid second angular position relative to one another. In this way, once the connection element has been coupled to the first and second decorative elements by the aforesaid first and second bayonet-type engaging devices, the reverse rotation of the connection element relative to each of the two decorative elements from the second angular position to the first angular position is prevented, and therefore the disengagement of the connection element from both the decorative elements is also prevented.

Preferably, the first and second rotation-preventing devices are formed by suitably shaped inserts which are fixed to the connection element, for example by welding.

Further features and advantages of the present invention will become more apparent from the following detailed description, given purely by way of non-limiting examples with reference to the drawings.

DETAILED DESCRIPTION

Figure 1:
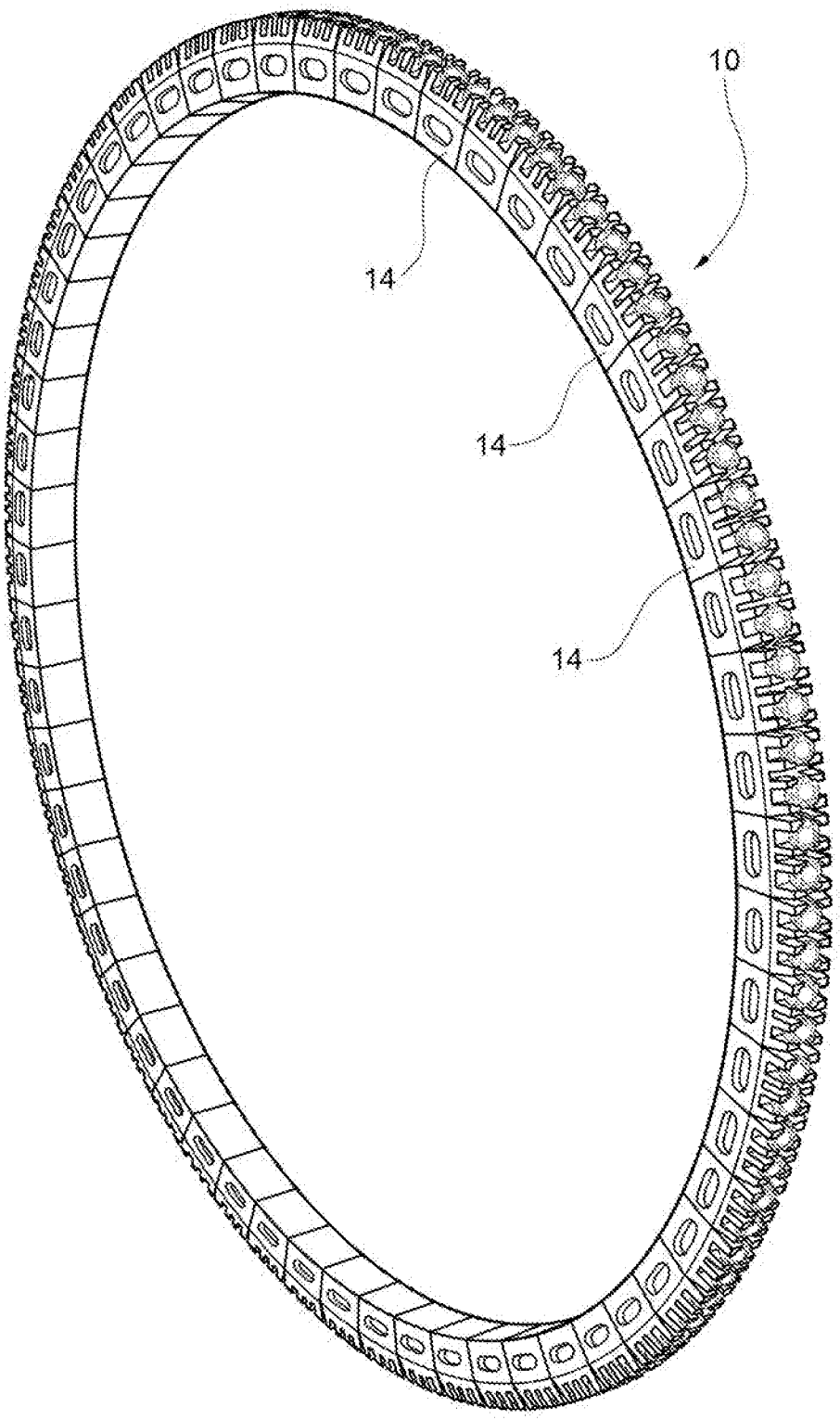
FIG. 1 is a perspective view of a bracelet, as an example of a jewelry item according to the present invention.

With reference first to FIG. 1, a jewelry item according to an embodiment of the present invention is generally indicated at 10. In the embodiment proposed herein, the jewelry item 10 is a bracelet and will therefore be referred to, for convenience, as bracelet in the in the remaining part of the description. Alternatively, the jewelry item may be a necklace or a ring.

The bracelet 10 basically comprises an elastic element 12 (a portion of its length being shown in FIG. 2) which extends over the entire length of the bracelet, and a plurality of decorative elements 14, which are threaded in one after the other onto the elastic element 12 so as to be slidable relative to the latter and are connected to one another.

The elastic element 12 is preferably formed by a mechanical spring (and for this reason it will be hereinafter referred to, for convenience, as spring), for example a cylindrical helical spring.

The bracelet 10 is shown in FIG. 1 in the condition of normal use, wherein the decorative elements 14 are in contact with one another. In such condition, the bracelet 10 extends, according to the embodiment illustrated herein, along a substantially circular extension direction s. Alternatively, the bracelet 10 may be configured to extend, in the normal use condition, along a non-circular extension direction, for example along an extension direction having an oval or similar shape. The extension direction s lies in a plane, hereinafter referred to as the extension plane The term "longitudinal" is used to indicate a direction tangent to the extension direction s, while the term "radial" is used to indicate a direction perpendicular to the extension direction s and lying in the extension plane.

The bracelet 10 has no closure. In order to wear the bracelet 10, the user simply has to extend it, against the elastic action of the spring 12, moving the decorative elements 14 away from one another up to a maximum relative distance. By releasing the bracelet 10, the decorative elements 14 return in contact with each other (normal use condition shown in FIG. 1) under the elastic action of the spring 12.

In the embodiment shown in the drawings, the decorative elements 14 are provided with settings 16 to receive one or more gemstones or diamonds 18. The presence of settings is not, however, an essential feature of the invention.

With reference now to FIGS. 2 to 10, the structure of each decorative element 14 of the bracelet 10 and the way each decorative element 14 is connected to each of the two decorative elements adjacent thereto will be described in detail.

Figure 5:
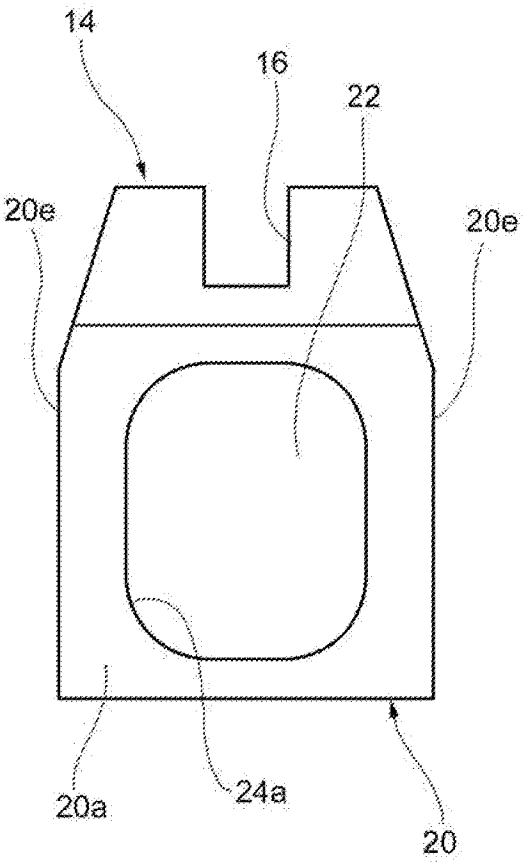
FIGS. 3, 4 and 5 are a perspective view, a side view and a front view of a decorative element of the bracelet of FIG. 1, respectively.
Figure 4:
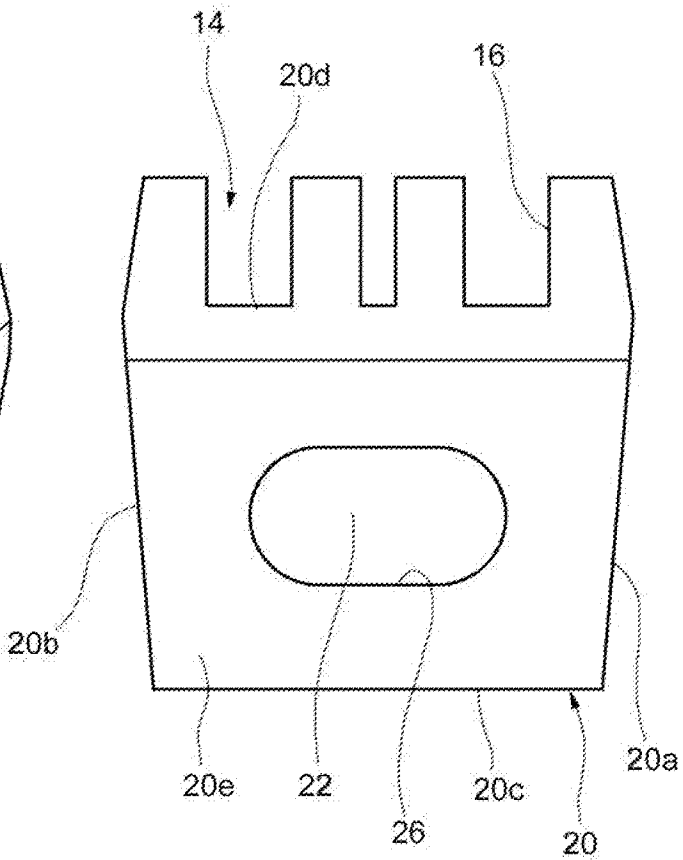
Figure 3:
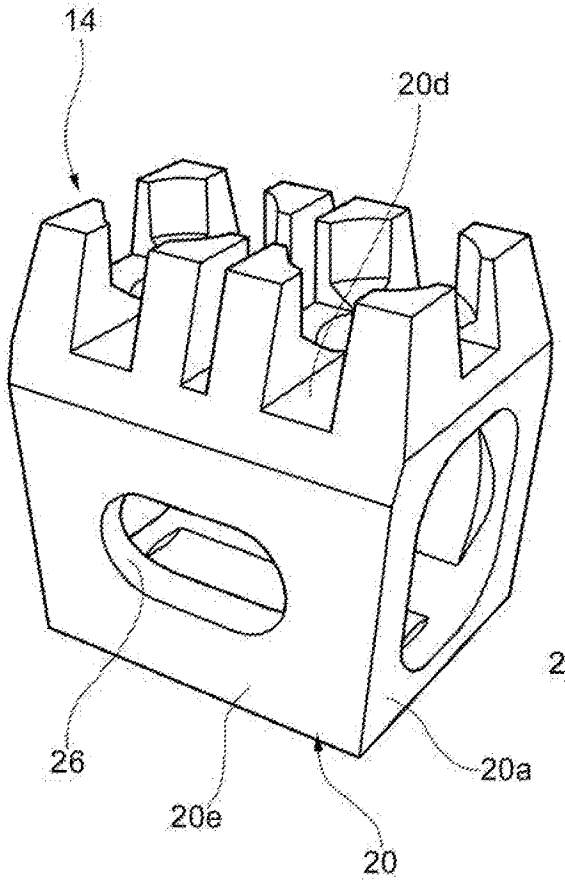

Each decorative element 14 comprises a body 20 preferably having an overall parallelepiped shape. The body 20 is a hollow body having an internal cavity 22. The body 20 is made of metal, in particular a precious metal, such as gold. The body 20 may be produced, for example, by machining or micro-casting process. The body 20 has a first pair of longitudinally opposite faces 20*a* and 20*b*, that is, a right face 20*a* and a left face 20*b*, respectively, a second pair of radially opposite faces 20*c* and 20*d*, that is, an internal face 20*c* and an external face 20*d*, respectively, and a third pair of side faces 20*e* (FIGS. 3 to 5).

The two longitudinally opposite faces 20*a* and 20*b* are advantageously inclined to one another so as to converge in a radially inwards, i.e. towards the center of the circumference along which the extension direction s extends. However, such faces might be parallel to each other to allow the manufacture of bracelets or necklaces having, in the normal use condition, one or more rectilinear, rather than curvilinear, sections.

The right face 20*a* has a first through opening 24*a* in communication with the internal cavity 22. Likewise, the left face 20*b* has a second through opening 24*b* in communication with the internal cavity 22. The first and second through openings 24*a* and 24*b* are preferably identical to one another and have an elongated shape in one direction, for example a substantially rectangular shape with a major axis oriented vertically, i.e. perpendicular to the internal face 20*c* of the body 20, and with four rounded corners.

The two radially opposite faces 20*c* and 20*d* are preferably arranged parallel to each other, in particular tangentially to the extension direction s. Where required (as in the illustrated embodiment), the external face 20*d* of the body 20 has one or more settings 16. In the proposed example, two settings 16 are provided, each of which is adapted to receive a respective gemstone 18. However, a different number of settings 16 may be provided.

The two side faces 20*e* are preferably arranged parallel to one another and parallel to the extension plane. According to the embodiment shown in the drawings, the two side faces 20*e* each have an opening or window 26, for example in the form of a slot, communicating with the internal cavity 22, but might even be completely closed.

Figure 2:
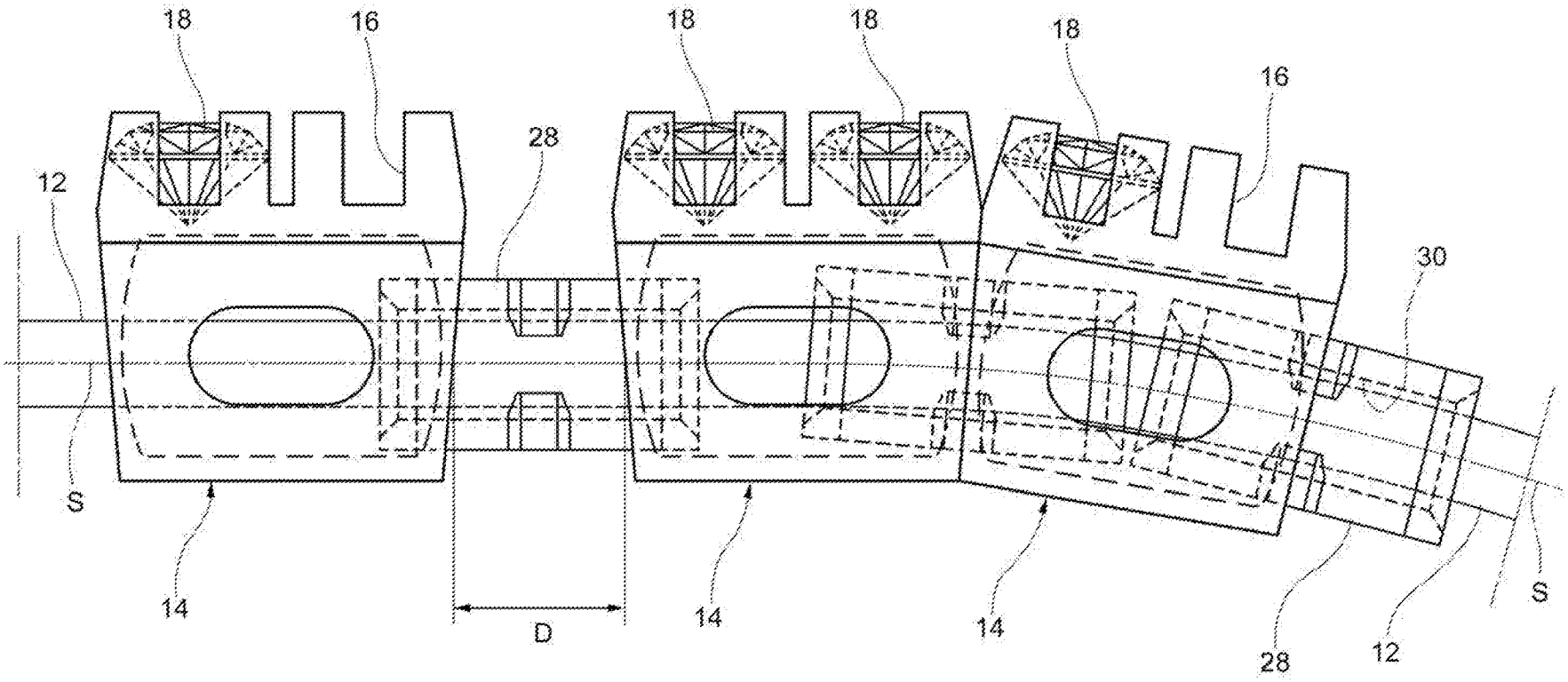
FIG. 2 is a side view of a portion of the bracelet of FIG. 1.

FIG. 2 shows three consecutive decorative elements 14, wherein the first two (in order from left to right) are positioned at the maximum relative distance (indicated with D) from each other, while the last two are positioned at no distance from each other, with the right face 20*a* of the one in contact with the left face 20*b* of the other.

Moreover, for each pair of decorative elements 14 the item 10 comprises a connection element 28 which extends along the longitudinal direction s and is coupled on one side (left side), by a first bayonet-type engaging device, with a decorative element 14 (hereinafter referred to as first decorative element) and on the other side (right side), by a second bayonet-type engaging device, with the other decorative element 14 (hereinafter referred to as second decorative element).

The connection element 28 has a longitudinal through hole 30 through which the spring 12 extends (FIG. 2).

Figure 6:
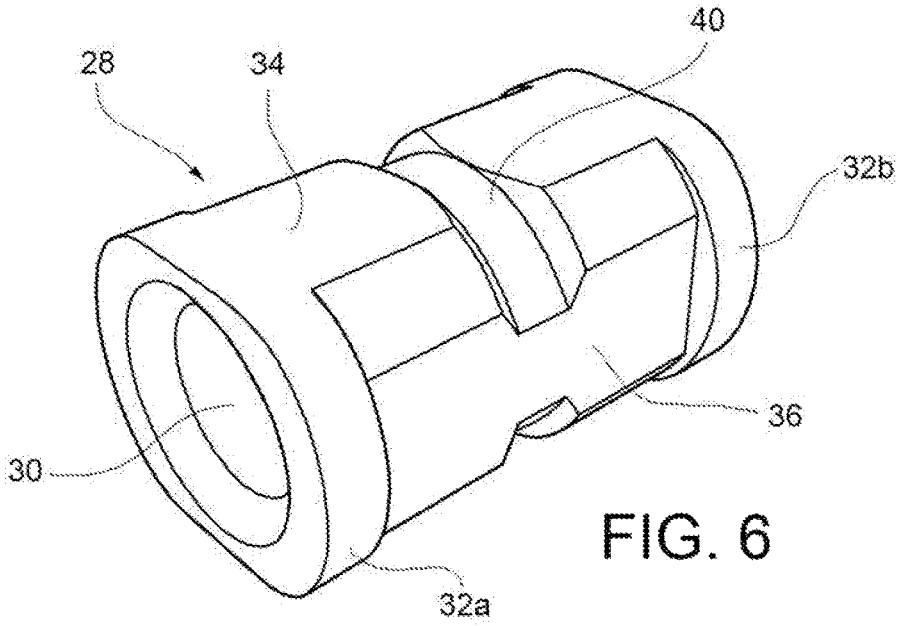
FIGS. 6, 7 and 8 are a perspective view, a side view and a front view of a connection element of the bracelet of FIG. 1, respectively.
Figure 7:
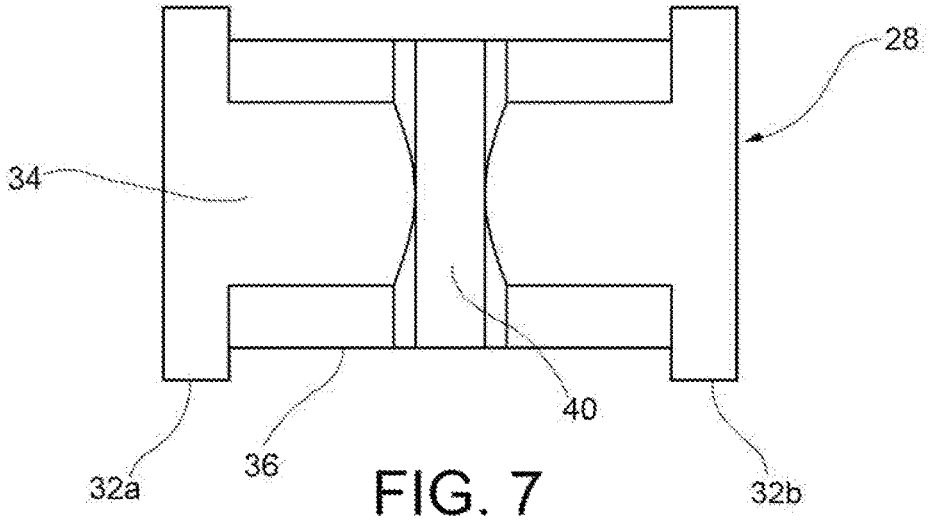
Figure 8:
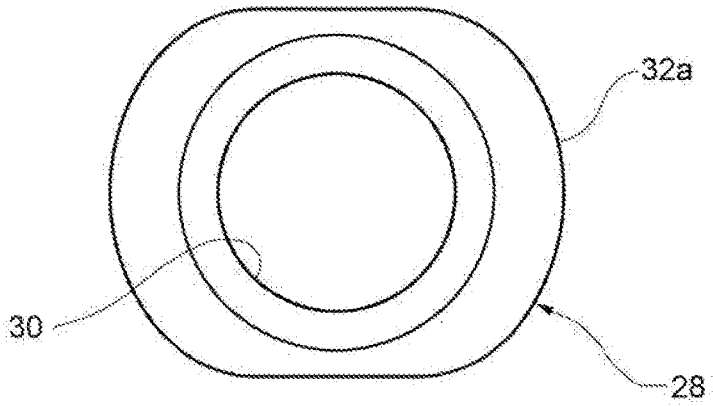

As shown in FIGS. 6 to 8, the connection element 28 comprises a first head portion 32*a*, which faces the first decorative element 14 and has an enlarged section with a shape corresponding to that of the first through opening 24*a* of the first decorative element 14, and, on the longitudinally opposite side, a second head portion 32*b*, which faces the second decorative element 14 and has an enlarged section with a shape corresponding to that of the second through opening 24*b* of the second decorative element 14. The intermediate portion (indicated at 34) of the connection element 28 has at least one pair of flat and parallel faces 36 which in the assembled condition serve as guide surfaces for the sliding of the connection element 28 in the longitudinal direction relative to the two decorative elements 14 coupled thereto.

The first head portion 32*a* of the connection element 28 acts as first male engaging part of the aforesaid first bayonet-type engaging device, while the first through opening 24*a*, together with the internal cavity 22 of the body 20 of the first decorative element 14, acts as first female engaging part of the aforesaid first bayonet-type engaging device. Likewise, the second head portion 32*b* of the connection element 28 acts as second male engaging part of the aforesaid second bayonet-type engaging device, while the second through opening 24*b*, together with the internal cavity 22 of the body 20 of the second decorative element 14, acts as second female engaging part of the aforesaid second bayonet-type engaging device.

The connection of each pair of adjacent decorative elements 14 by the connection element 28 is obtained through the following steps:

- insertion of the first head portion 32*a* of the connection element 28 into the internal cavity 22 of the body 20 of the first decorative element 14, with the connection element 28 and the first decorative element 14 arranged relative to one another in a first angular position such that the major axis of the cross-section of the first head portion 32*a* is aligned with the major axis of the first through opening 24*a*, and therefore the first head portion 32*a* is allowed to pass through the first through opening 24*a;*
- rotation of the connection element 28 relative to the first decorative element 14 so as to arrange these elements relative to one another in a second angular position rotated by a certain angle (typically an angle between 30° and 150°, preferably 90°) relative to the first angular position defined above, so as to prevent the first head portion 32*a* of the connection element 28 from disengaging from the body 20 of the first decorative element 14;
- insertion of the second head portion 32*b* of the connection element 28 into the internal cavity 22 of the body 20 of the second decorative element 14 through the second through opening 24*b*, with the connection element 28 and the second decorative element 14 arranged relative to one another in the aforementioned first angular position; and
- rotation of the connection element 28 relative to the second decorative element 14 so as to arrange such elements relative to one another in the aforesaid second angular position and thus prevent the second head portion 32*b* of the connection element 28 from disengaging from the body 20 of the second decorative element 14.

By repeating these steps for each pair of adjacent decorative elements 14 (with the possible exception of the last pair of adjacent decorative elements 14, which are preferably coupled to each other by using, for example, a connection element provided at the opposite ends thereof with latches arranged to be secured to the bodies of the two adjacent decorative elements by inserts which are welded to such bodies and cooperate with the latches of the connection element), the complete assembly of the jewelry item 10 is obtained.

Preferably, in order to avoid any risk of disengagement of the decorative element from the connection element, which could occur in case of accidental rotation of such elements from the aforesaid second angular position to the aforesaid first angular position, a first rotation-preventing device is associated to each connection element 28 to prevent rotation of the connection element 28 relative to the first decorative element 14 when these elements are in the aforesaid second angular position, as well as a second rotation-preventing device is arranged to prevent rotation of the connection element 28 relative to the second decorative element 14 when these elements are in the aforesaid second angular position. In this way, once the connection element 28 has been coupled to the first and second decorative element 14 by the aforesaid first and second bayonet-type engaging devices, reverse rotation of the connection element 28 relative to each of the two decorative elements 14 from the second angular position to the first angular position is prevented.

Figure 9:
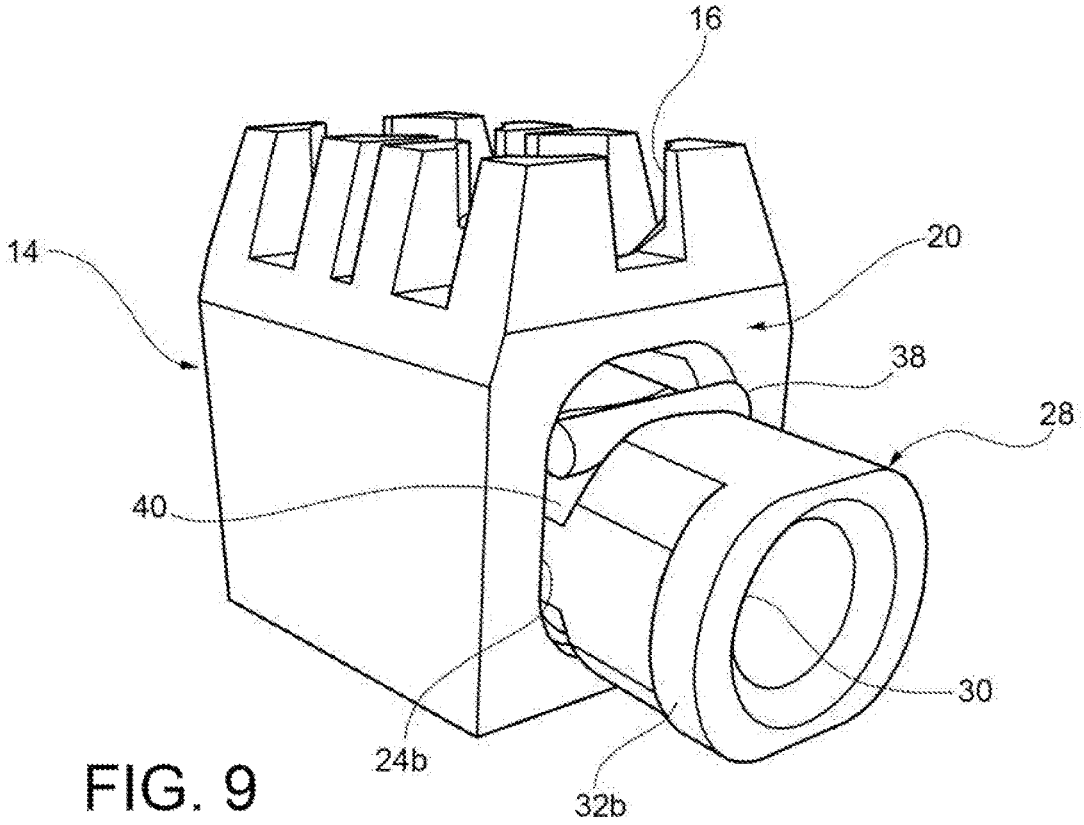
FIG. 9 is a perspective view showing an example of rotation locking between a connection element and a decorative element of the bracelet of FIG. 1.

As shown in FIG. 9, the rotation-preventing device may be formed by a pin-shaped insert 38 which is fixed to the connection element 28, for example by welding, at a circumferential groove 40 which is provided in the intermediate portion 34 of the connection element 28 and is arranged with its longitudinal axis parallel to the major axis of the cross-section of the head portion 32*a*, 32*b* of the connection element 28.

Figure 10:
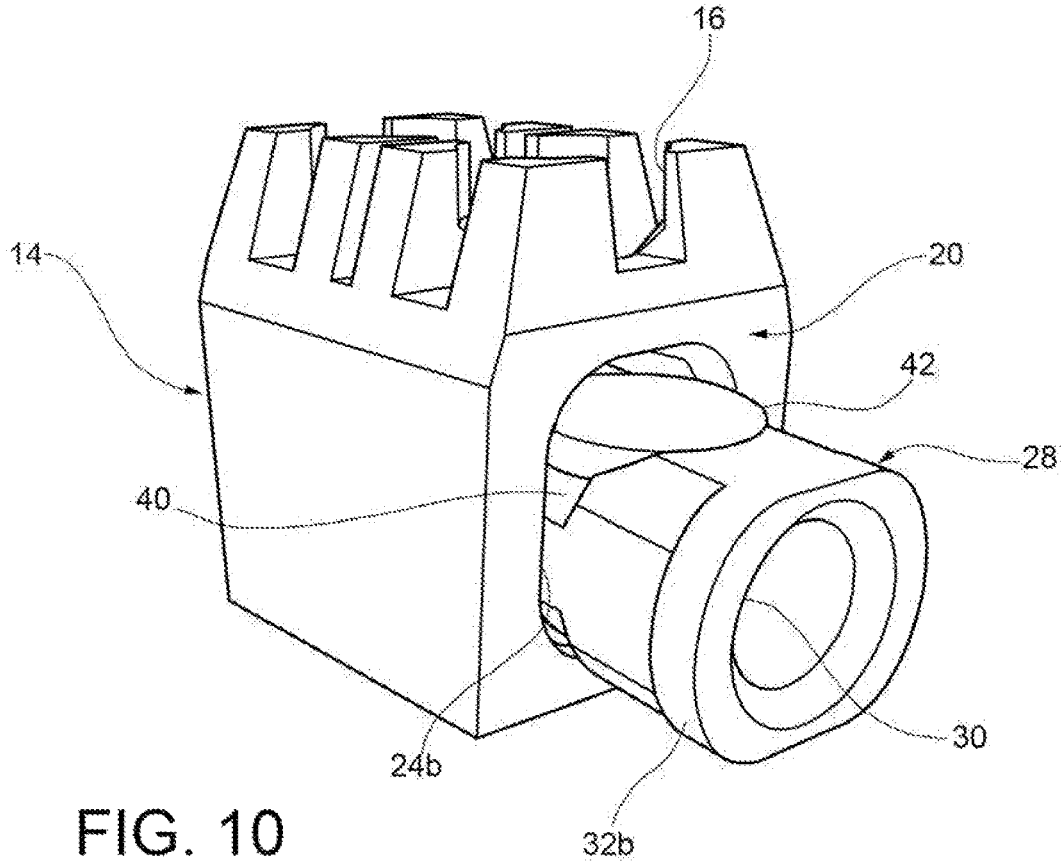
FIG. 10 is a perspective view showing a further example of rotation locking between a connection element and a decorative element of the bracelet of FIG. 1.

Alternatively, as shown in FIG. 10, the rotation-preventing device may be formed by a disc-shaped insert 42 which is fixed to the connection element 28, for example by welding, at the intermediate portion 34 of such element.

Both the insert 38 and the insert 42 are configured so as to allow the connection element 28 and the two decorative elements 14 coupled thereto to slide relative to one another in the longitudinal direction, but to prevent the connection element 28 from rotating relative to the two decorative elements 14 coupled thereto.

The main advantages achievable with the present invention are, on the one hand, the ease and speed of assembly of the jewelry item and, on the other, the fact of allowing a jewelry item to be made that has decorative elements of very reduced dimensions, with a width on the order, for example, of 2 mm.

Naturally, the principle of the invention remaining unchanged, the embodiments and the constructional details may be greatly modified with respect to those described purely by way of non-limiting examples, without thereby departing from the scope of the invention as described and claimed herein.

The invention claimed is:

1. A jewelry item, in particular a bracelet, a necklace or a ring, comprising an elastic element extending along an extension direction of the jewelry item over an entire length of the jewelry item, and a plurality of decorative elements which are threaded one after the other on the elastic element so as to be slidable with respect to the elastic element and are non-releasably connected to each other, wherein each decorative element of said plurality of decorative elements comprises a hollow body having a pair of longitudinally opposite first faces, that is, a right face and a left face, respectively, and a pair of radially opposite second faces, that is, an internal face and an external face, respectively, wherein the right face and the left face of each decorative element have a first through opening and a second through opening, respectively, said first through opening and second through opening communicating with an internal cavity of the decorative element, and wherein the jewelry item further comprises, for each pair of adjacent decorative elements, a connection element, which is threaded on the elastic element and is connected on one side to a first decorative element of said pair of adjacent decorative elements and on a longitudinally opposite side with a second decorative element of said pair of adjacent decorative elements, whereby said first decorative element and said second decorative element are movable relative to each other, sliding on the connection element, between a position of minimum relative distance and a position of maximum relative distance, wherein each connection element is connected to a respective first decorative element of said plurality of decorative elements by a respective first bayonet engaging device comprising a first male engaging part formed by a first enlarged-section head portion of the connection element and a first female engaging part formed by said first through opening and by the internal cavity of the hollow body of said first decorative element, wherein each connection element is connected to a respective second decorative element of said plurality of decorative elements by a respective second bayonet engaging device comprising a second male engaging part formed by a second enlarged-section head portion of the connection element, on an opposite side to said first enlarged-section head portion, and a second female engaging part formed by said second through opening and by the internal cavity of the hollow body of said second decorative element, and wherein said first bayonet engaging device and said second bayonet engaging device are configured in such a way that coupling between the connection element and the respective first decorative element and coupling between the connection element and the respective second decorative element are obtained through insertion of the first male engaging part of the connection element into the first female engaging part of the first decorative element and through insertion of the second male engaging part of the connection element into the second female engaging part of the second decorative element, with the connection element being placed in a given first angular position relative to the first decorative element and the second decorative element, and then through rotation by a given angle of the connection element relative to the first decorative element and the second decorative element, so as to place the connection element in a given second angular position relative to the first decorative element and the second decorative element, rotated with respect to said first angular position, in which second angular position the first male engaging part of the connection element is secured in the hollow body of the first decorative element and the second male engaging part of the connection element is secured in the hollow body of the second decorative element and thus prevent the connection element from disengaging from the first decorative element and the second decorative element.

2. The jewelry item of claim 1, further comprising, for each connection element, a respective rotation-preventing device which prevents the connection element from rotating relative to said first and second decorative elements when these elements are in said second angular position with respect to each other.

3. The jewelry item of claim 2, wherein each of said rotation-preventing devices comprises at least one insert fixed to the connection element in an intermediate portion of the connection element between said first enlarged-section head portion and said second enlarged-section head portion.

4. The jewelry item of claim 1, wherein the external face of the hollow body of each decorative element is provided with at least one setting for receiving a respective gemstone.

5. The jewelry item of claim 1, wherein said first faces of the hollow body of each decorative element are inclined to each other so as to converge radially inwards.

* * * * *